US008859924B2

(12) United States Patent
Yeon et al.

(10) Patent No.: US 8,859,924 B2
(45) Date of Patent: Oct. 14, 2014

(54) GAS CIRCUIT BREAKER

(75) Inventors: Je Uk Yeon, Cheongju-si (KR); Seok Weon Park, Gunpo-si (KR); Jong Ung Choi, Cheongwon-gun (KR)

(73) Assignee: LSIS Co., Ltd., Anyang-Si, Gyeonggi-Do (KR)

( * ) Notice: Subject to any disclaimer, the term of this patent is extended or adjusted under 35 U.S.C. 154(b) by 248 days.

(21) Appl. No.: 13/550,442

(22) Filed: Jul. 16, 2012

(65) Prior Publication Data

US 2013/0020286 A1 Jan. 24, 2013

(30) Foreign Application Priority Data

Jul. 20, 2011 (KR) ..... 10-2011-0072152

(51) Int. Cl.
*H01H 33/18* (2006.01)
*H01H 33/90* (2006.01)

(52) U.S. Cl.
CPC ..... *H01H 33/904* (2013.01)
USPC ..... 218/43; 218/61

(58) Field of Classification Search
USPC ..... 218/43, 61
See application file for complete search history.

(56) References Cited

U.S. PATENT DOCUMENTS

| | | | | |
|---|---|---|---|---|
| 5,293,014 | A * | 3/1994 | Perret | 218/57 |
| 5,600,111 | A * | 2/1997 | Dufournet | 218/61 |
| 5,859,399 | A * | 1/1999 | Perret | 218/60 |
| 6,018,133 | A * | 1/2000 | Thuries | 218/43 |
| 6,472,628 | B2 * | 10/2002 | Nauche et al. | 218/43 |
| 8,030,590 | B2 * | 10/2011 | Yoshida et al. | 218/61 |
| 2002/0000425 | A1 * | 1/2002 | Nauche et al. | 218/43 |
| 2002/0113040 | A1 * | 8/2002 | Imamura et al. | 218/43 |
| 2003/0127430 | A1 * | 7/2003 | Iwabuchi et al. | 218/43 |
| 2003/0231452 | A1 * | 12/2003 | Hetzmannseder et al. | 361/120 |

FOREIGN PATENT DOCUMENTS

| | | |
|---|---|---|
| CN | 1056766 | 12/1991 |
| CN | 2546996 | 4/2003 |
| CN | 1790578 | 6/2006 |
| DE | 3113325 | 6/1982 |
| JP | 2007-157376 | 6/2007 |
| RU | 2024093 | 11/1994 |

OTHER PUBLICATIONS

Russian Federation Federal Service for Intellectual Property, Patents and Trademarks Application Serial No. 2012130965/07, Notice of Allowance dated Oct. 23, 2013, 7 pages.
The State Intellectual Property Office of the People's Republic of China Application Serial No. 201210253660.1, Office Action dated May 27, 2014, 7 pages.

* cited by examiner

*Primary Examiner* — Truc Nguyen
(74) *Attorney, Agent, or Firm* — Lee, Hong, Degerman, Kang & Waimey

(57) ABSTRACT

Provided is a gas circuit breaker. The gas circuit breaker includes a fixed part, a movable part, a piston, and a double compression mechanism. The fixed part includes a fixed arc contact and a first fixed contact maker. The movable part includes a movable arc contact selectively making contact with the fixed arc contact, a cylinder in which the movable arc contact is disposed, and a second fixed contact maker guiding a movement of the cylinder. The piston is disposed in the second fixed contact maker. The double compression mechanism is configured to move the piston in a direction opposite to a moving direction of the movable part when the movable part is moved to separate the fixed arc contact and the movable arc contact for interrupting a fault current.

15 Claims, 5 Drawing Sheets

GAS CIRCUIT BREAKER

CROSS-REFERENCE TO RELATED APPLICATIONS

Pursuant to 35 U.S.C. §119(a), this application claims the benefit of earlier filing date and right priority to Korean Patent Application No. 10-2011-0072152, filed on Jul. 20, 2011, the content of which are all hereby incorporated by reference herein in its entirety.

BACKGROUND

The present disclosure relates to a gas circuit breaker.

Generally, a gas circuit breaker is disposed on a power transmission line to disconnect the power transmission line for inspecting the power transmission line and other devices or protecting the power transmission line and load devices by interrupting a current in an abnormal condition. Particularly, a gas circuit breaker can safely protect an extra-high voltage power system by interrupting a fault current caused by a ground fault or short circuit. In more detail, so as to interrupt a fault current in an abnormal state having severe conditions, a gas circuit breaker compresses highly insulative arc-extinguishing gas and injects the arc-extinguishing gas at a high pressure through a nozzle to extinguish arcs generating while a current is interrupted.

In the case of a hybrid arc-extinguishing circuit breaker, arc energy of a fault current is used as an energy source of an expansion chamber to interrupt the fault current. For this, in an early current-interrupting operation stage of the hybrid arc-extinguishing circuit breaker, it is necessary to move a large amount of gas from a compression chamber to the expansion chamber.

FIG. 1 is a sectional view illustrating an insertion state of a gas circuit breaker of the related art, and FIG. 2 is a sectional view illustrating an open state of the gas circuit breaker.

Referring to FIGS. 1 and 2, the gas circuit breaker of the related art includes an interruption part for interrupting a fault current, and the interruption part is composed of a fixed part and a movable part. When a current is interrupted, the fixed part may not move, and the movable part may move.

In detail, the fixed part includes a fixed arc contact 1 and a fixed main contact 3. The movable part includes a nozzle 2, a movable arc contact 4, a cylinder 5, an expansion chamber 6, a compression chamber 7, and a manipulation device connecting part 8.

In current interruption mode, the entirety of the movable part is moved using energy received from a manipulation device. At this time, the compression chamber 7 is compressed, and thus gas can be injected at a high pressure through the expansion chamber 6 and the nozzle 2 for interrupting a fault high current. Gas injected from the compression chamber 7 extinguishes an arc generating when the contacts are opened, that is, an arc generating between the fixed arc contact 1 and the movable arc contact 4.

As described above, if the related-art gas circuit breaker has an arc-extinguishing part divided into the compression chamber 7 and the expansion chamber 6 to use arc energy for interrupting a fault current, sufficient expansion energy is necessary for current interrupting. Therefore, when the gas circuit breaker is initially operated, a large amount of $SF_6$ gas is supplied into the compression chamber 7 to maintain the inside of the compression chamber 7 at a high pressure.

However, this increases an expansion length of the gas circuit breaker or the cross-sectional area of the compression chamber 7.

SUMMARY

Embodiments provide a gas circuit breaker that can interrupt a fault current with less energy necessary for manipulation.

In one embodiment, a gas circuit breaker includes: a fixed part including a fixed arc contact and a first fixed contact maker; a movable part including a movable arc contact selectively making contact with the fixed arc contact, a cylinder in which the movable arc contact is disposed, and a second fixed contact maker guiding a movement of the cylinder; a piston disposed in the second fixed contact maker; and a double compression mechanism configured to move the piston in a direction opposite to a moving direction of the movable part when the movable part is moved to separate the fixed arc contact and the movable arc contact for interrupting a fault current.

In another embodiment, a gas circuit breaker includes: a fixed part including a fixed arc contact and a first fixed contact maker; a movable part including a movable arc contact selectively making contact with the fixed art contact, a cylinder in which the movable arc contact is disposed, a second fixed contact maker guiding a movement of the cylinder, and a manipulation device connecting part; a piston disposed in the second fixed contact maker, the manipulation device connecting part being inserted through the piston; a pin protruding from a surface of the manipulation device connecting part; a roller having an end rotatably connected to the piston and configured to be rotated by the pin; and a rotation shaft supporting the roller in a manner such that the roller is rotatable in the second fixed contact maker.

In further another embodiment, a gas circuit breaker includes: a fixed part including a fixed arc contact and a first fixed contact maker; a movable part including a movable arc contact selectively making contact with the fixed art contact, a cylinder in which the movable arc contact is disposed, a second fixed contact maker guiding a movement of the cylinder, and a manipulation device connecting part; a piston disposed in the second fixed contact maker, the manipulation device connecting part being inserted through the piston; a pin protruding from a surface of the manipulation device connecting part; a roller having an end rotatably connected to the piston and configured to be rotated by the pin; and a rotation shaft supporting the roller in a manner such that the roller is rotatable in the second fixed contact maker, wherein if the manipulation device connecting part is moved in a predetermined direction to separate the movable arc contact from the fixed arc contact for interrupting a fault current, the roller is rotated on the rotation shaft by the pin, and thus the piston is moved in a direction opposite to the predetermined direction.

DETAILED DESCRIPTION OF THE EMBODIMENTS

Hereinafter, structures and operations of a gas circuit breaker will be described in detail with respect to the accompanying drawings in which exemplary embodiments are shown.

Figure 1:
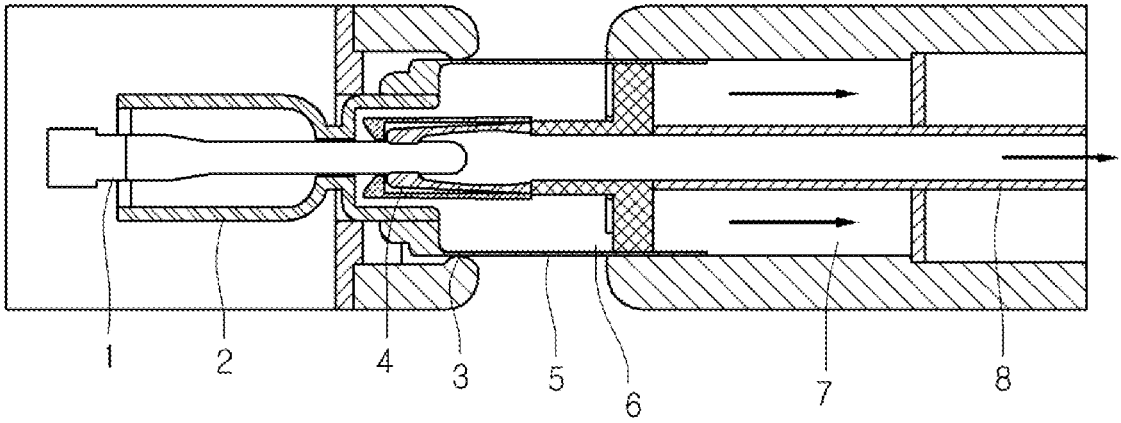
FIG. 1 is a sectional view illustrating an insertion state of a gas circuit breaker of the related art.
Figure 2:
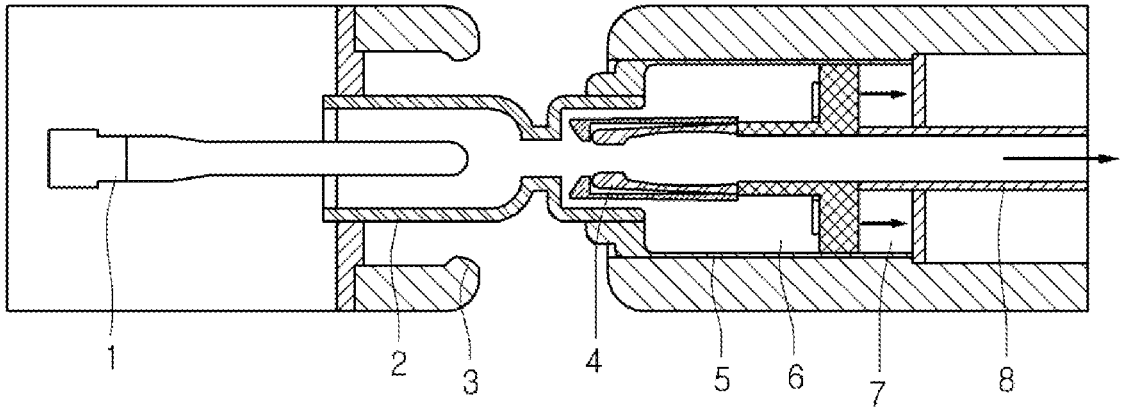
FIG. 2 is a sectional view illustrating an open state of the gas circuit breaker.
Figure 3:
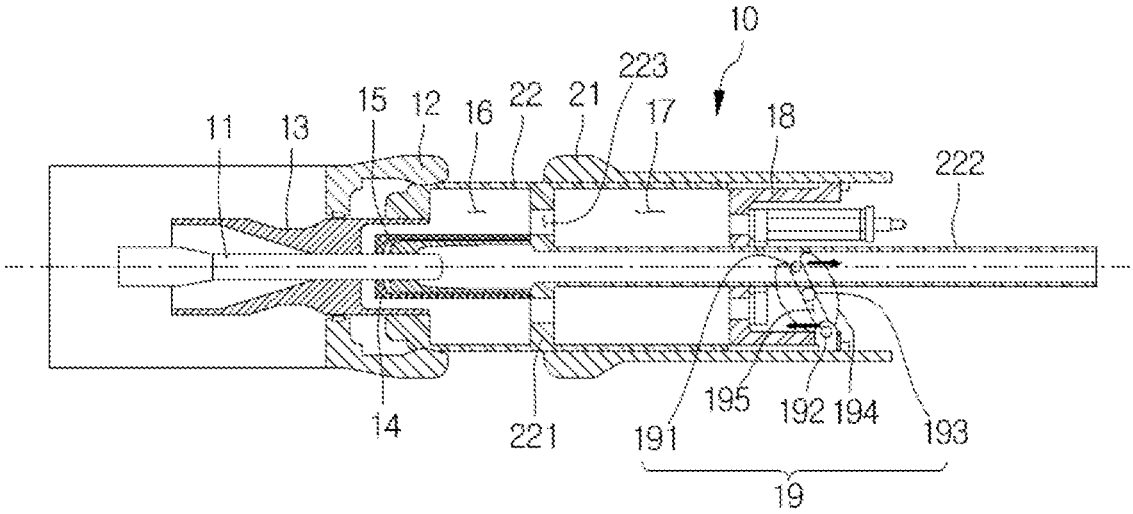
FIG. 3 is a sectional view illustrating an insertion state of a gas circuit breaker according to an embodiment.
Figure 4:
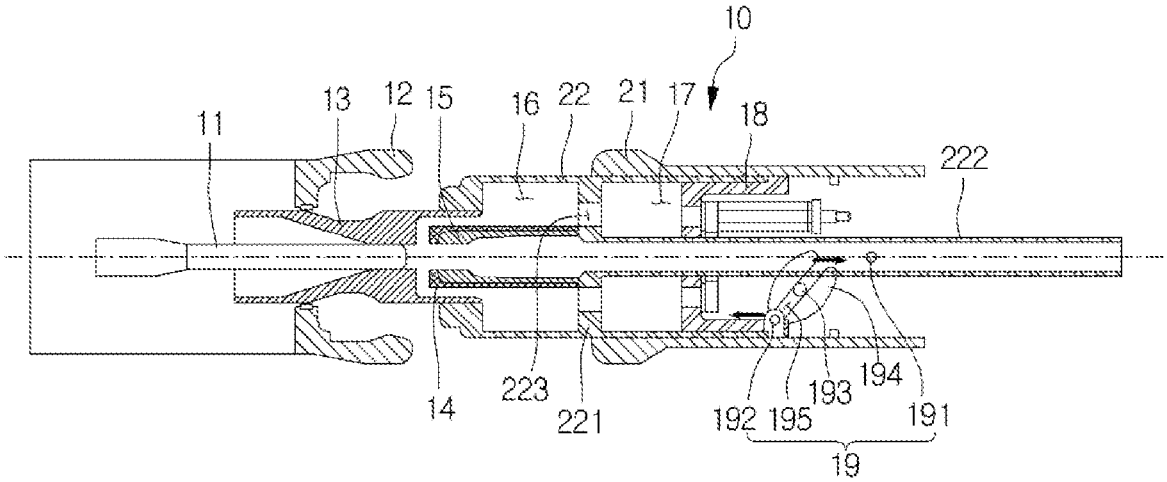
FIG. 4 is a sectional view illustrating a transitional state of the gas circuit breaker.

FIG. 3 is a sectional view illustrating an insertion state of a gas circuit breaker 10 according to an embodiment; FIG. 4 is a sectional view illustrating a transitional state of the gas circuit breaker 10; and FIG. 5 is a sectional view illustrating an open state of the gas circuit breaker 10.

Figure 5:
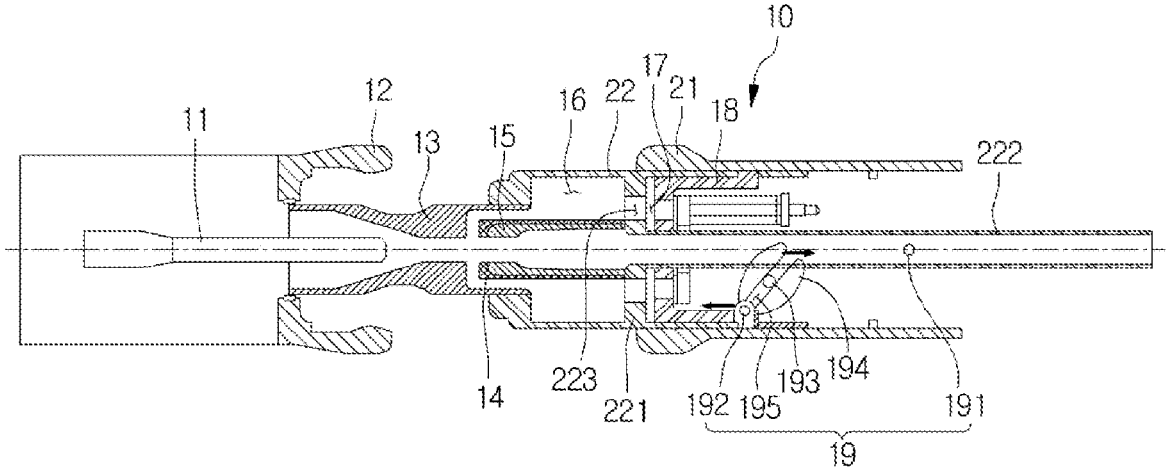
FIG. 5 is a sectional view illustrating an open state of the gas circuit breaker.

Referring to FIGS. 3 to 5, the gas circuit breaker 10 of the current embodiment includes a fixed part and a movable part. The basic configuration of the gas circuit breaker 10 may be similar to that of a gas circuit breaker of the related art. The fixed part includes a fixed arc contact 11, and a first fixed contact maker 12 in which the fixed arc contact 11 is disposed. The movable part includes a first nozzle 13 in which the fixed arc contact 11 is inserted, a cylinder 22 connected to an end of the first nozzle 13, a second fixed contact maker 21 in which cylinder 22 is movably disposed, and a piston 18 movably disposed in the second fixed contact maker 21.

In more detail, the inside of the cylinder 22 includes an expansion chamber 16 and a compression chamber 17 that are separated by a barrier 221. A communication hole 223 is formed in the barrier 221 to connect the expansion chamber 16 and the compression chamber 17.

In the cylinder 22, a manipulation device connecting part 222 extends from a center portion of the barrier 221. The manipulation device connecting part 222 passes through the compression chamber 17 and the piston 18.

The end of the first nozzle 13 is connected to an end of the cylinder 22. A second nozzle 14 extends from a side of the barrier 221 toward the first nozzle 13. A movable arc contact 15 is disposed in the second nozzle 14. The movable arc contact 15 also extends from the barrier 221 and is disposed close to the inner wall of the second nozzle 14. In an insertion state, the fixed arc contact 11 is inserted in the first nozzle 13 and the second nozzle 14 and is kept in contact with the movable arc contact 15.

An end of the piston 18 is connected to the manipulation device connecting part 222 through a double compression mechanism 19. The double compression mechanism 19 includes a pin 191 protruding from a surface of the manipulation device connecting part 222, a roller 193 hinged on the end of the piston 18 using a hinge shaft 192, and a rotation shaft 194 through which the roller 193 is rotatably connected to the inner surface of the second fixed contact maker 21. Owning to the rotation shaft 194, the roller 193 is rotatably kept in the second fixed contact maker 21. A guide part 195 is provided in the roller 193 to guide the pin 191. The guide part 195 may be a groove or hole formed in the roller 193.

Hereinafter, an exemplary operation of the gas circuit breaker 10 will be described according to an embodiment.

First, as shown in FIG. 3, in interruption mode of the gas circuit breaker 10, an inserted interruption part of the gas circuit breaker 10 is pulled out as the movable part is moved away from the fixed part by energy of a circuit breaker manipulation device. In the way, the gas circuit breaker 10 enters in an open state shown in FIG. 5 after a transitional state shown in FIG. 4.

In detail, as the movable part is moved by energy applied by the circuit breaker manipulation device, the first nozzle 13 is moved to the right side in FIG. 3. Then, the fixed arc contact 11 is separated from the movable arc contact 15, resulting in a high-voltage arc. In the transition from the insertion state to the transitional state, as the movable part is moved, the manipulation device connecting part 222 and the cylinder 22 are moved to the right side in FIG. 3. Therefore, the compression chamber 17 is reduced in volume and thus increased in pressure. Then, as the pin 191 disposed on a surface of the manipulation device connecting part 222 is moved to the right side, the roller 193 is rotated clockwise in FIG. 3. As the roller 193 is rotated clockwise, the piston 18 is moved to the left side in FIG. 3.

As the cylinder 22 is moved to the right side in FIG. 3, the compression chamber 17 is compressed. Along with this, the piston 18 is moved to the left side in FIG. 3 as the roller 193 is rotated, and thus the compression chamber 17 is further compressed. That is, as the double compression mechanism 19 operates, the compression chamber 17 is compressed in a double compressing manner.

Therefore, when the movable part is moved by a certain distance, owing to the double compression mechanism 19, the compression chamber 17 can be compressed to double the compression degree of a related-art compression chamber. That is, about double the amount of gas supplied to an expansion chamber in the related art can be supplied to the expansion chamber 16 through the communication hole 223 according to the embodiment. Own to this, the fixed arc contact 11 can be pushed by a twice large force, and thus the fixed arc contact 11 can be separated from the movable arc contact 15 more quickly. As a result, according to the embodiment, a fault current can be quickly interrupted.

If the pressure of the expansion chamber 16 becomes greater than the pressure of the compression chamber 17 owing to arc energy generated as the fixed arc contact 11 is separated from the movable arc contact 15, the double compression mechanism 19 does not operate. In other words, after the transitional state, the pin 191 is completely separated from the guide part 195 of the roller 193, and thus although the manipulation device connecting part 222 is further moved to the right side, the piston 18 is not moved to the left side. In addition, after the pressure of the expansion chamber 16 becomes greater than the pressure of the compression chamber 17 in the interruption mode, since the compression chamber 17 is compressed in one direction instead of being compressed in two directions, energy necessary for moving the movable part does not increase.

In the open state shown in FIG. 5, since the fixed arc contact 11 is completely separated from the movable arc contact 15, the inside of the first nozzle 13 communicates with the expansion chamber 16. Therefore, a high-voltage arc generating when the fixed arc contact 11 and the movable arc contact 15 are separated can be quickly extinguished by high-pressure arc-extinguishing gas supplied into the expansion chamber 16. That is, the arc-extinguishing gas is discharged from the expansion chamber 16 through a passage formed between an end of the first nozzle 13 and the second nozzle 14. Since the arc-extinguishing gas is discharged from the expansion chamber 16 at a high pressure and rate, an arc generating when the fixed arc contact 11 and the movable arc contact 15 are separated can be quickly extinguished. As a result, in addition to quick extinction of an arc, transmission of arc energy into the expansion chamber 16 can also be prevented.

In addition, according to the embodiment, a large amount of gas compressed in the compression chamber 17 can be supplied to the expansion chamber 16 in a short circuit breaker operating time without having to increase the inside volume of the compression chamber 17 owing to the double compression mechanism 19.

As described above, according to the embodiments, so as to interrupt a fault current, the compression chamber is compressed in a double compressing manner by adding a roller and a movable compression chamber support to an existing compression chamber structure configured to be compressed by a one-way motion. Therefore, according to the embodiments, a more amount of gas can be supplied from the compression chamber to the expansion chamber when the movable part is moved the same length as a movable part of the related art. Furthermore, in the case where the concepts of the embodiments are applied to a hybrid arc-extinguishing circuit breaker, a more amount of gas can be supplied in an early current-interrupting operation stage in which expansion chamber gas is expanded using arc energy, and thus a fault current can be interrupted more effectively.

In addition, according to the embodiments, since double compression is performed only in an early movement of the movable part, energy necessary for manipulation can be reduced when interrupting a fault current. That is, according to the embodiments, the compression chamber is double-compressed only in an early operation stage and is then compressed in a single way by moving the movable, so that energy necessary for manipulation does not increase during the operation for interrupting a fault current.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A gas circuit breaker comprising:

a fixed part comprising a fixed arc contact and a first fixed contact maker;

a movable part comprising a movable arc contact selectively making contact with the fixed arc contact, a cylinder in which the movable arc contact is disposed, and a second fixed contact maker guiding a movement of the cylinder;

a piston disposed in the second fixed contact maker; and a double compression mechanism configured to move the piston in a direction opposite to a moving direction of the movable part when the movable part is moved to separate the fixed arc contact and the movable arc contact for interrupting a fault current, wherein the movable part further comprises a manipulation device connecting part extending from a side of a barrier dividing an inner space of the cylinder into a compression chamber and an expansion chamber, and the manipulation device connection part is inserted through the piston, wherein the movable arc contact extends from the other side of the barrier and is disposed in the expansion chamber.

2. The gas circuit breaker according to claim 1, further comprising a second nozzle enclosing the movable arc contact.

3. The gas circuit breaker according to claim 1, wherein an end of the double compression mechanism is connected to a side of the piston in the second fixed contact maker in a state that the end of the double compression mechanism is at least partially rotatable, and the other end of the double compression mechanism is selectively connected to the manipulation device connecting part.

4. A gas circuit breaker comprising:

a fixed part comprising a fixed arc contact and a first fixed contact maker;

a movable part comprising a movable arc contact selectively making contact with the fixed art contact, a cylinder in which the movable arc contact is disposed, a second fixed contact maker guiding a movement of the cylinder, and a manipulation device connecting part;

a piston disposed in the second fixed contact maker, the manipulation device connecting part being inserted through the piston;

a pin protruding from a surface of the manipulation device connecting part;

a roller having an end rotatably connected to the piston and configured to be rotated by the pin; and a rotation shaft supporting the roller in a manner such that the roller is rotatable in the second fixed contact maker.

5. The gas circuit breaker according to claim 4, wherein a guide part is disposed at the other end of the roller such that the pin is selectively caught by the guide part.

6. The gas circuit breaker according to claim 5, wherein the guide part is a groove or a hole in which the pin is selectively caught.

7. The gas circuit breaker according to claim 4, wherein when the manipulation device connecting part is moved, the pin pushes the other end of the roller to rotate the roller, and the piston is moved in a direction opposite to the moving direction of the manipulation device connecting part by the rotation of the roller.

8. The gas circuit breaker according to claim 7, wherein the roller is rotated by the pin until the movable arc contact is separated from the fixed arc contact.

9. The gas circuit breaker according to claim 7, wherein after the movable arc contact is separated from the fixed arc contact, the pin is separated away from the roller.

10. The gas circuit breaker according to claim 7, wherein the piston is moved by the roller during a portion of a period in which a fault current is interrupted.

11. A gas circuit breaker comprising:

a fixed part comprising a fixed arc contact and a first fixed contact maker;

a movable part comprising a movable arc contact selectively making contact with the fixed art contact, a cylinder in which the movable arc contact is disposed, a second fixed contact maker guiding a movement of the cylinder, and a manipulation device connecting part;

a piston disposed in the second fixed contact maker, the manipulation device connecting part being inserted through the piston;

a pin protruding from a surface of the manipulation device connecting part;

a roller having an end rotatably connected to the piston and configured to be rotated by the pin; and a rotation shaft supporting the roller in a manner such that the roller is rotatable in the second fixed contact maker, wherein if the manipulation device connecting part is moved in a predetermined direction to separate the movable arc contact from the fixed arc contact for interrupting a fault current, the roller is rotated on the rotation shaft by the pin, and thus the piston is moved in a direction opposite to the predetermined direction.

12. The gas circuit breaker according to claim 11, wherein the pin is selectively caught by a guide part provided at the other end of the roller according to a distance that the manipulation device connecting part travels.

13. The gas circuit breaker according to claim 11, wherein the pin rotates the roller until the fixed arc contact is separated from the movable arc contact.

14. The gas circuit breaker according to claim 12, wherein after the movable arc contact is separated from the fixed arc contact, the pin is separated away from the roller.

15. The gas circuit breaker according to claim 11, wherein the manipulation device connecting part extends from a side of a barrier dividing an inner space of the cylinder into a compression chamber and an expansion chamber.

* * * * *